US008813868B2

(12) United States Patent
Limberg et al.

(10) Patent No.: US 8,813,868 B2
(45) Date of Patent: Aug. 26, 2014

(54) AUXILIARY HANDLE FOR USE WITH A POWER TOOL

(75) Inventors: Kurt Limberg, Milwaukee, WI (US); Ryan T. Harrison, West Bend, WI (US); Mark A. Kubale, West Bend, WI (US); Mark D. Hickok, Waukesha, WI (US)

(73) Assignees: Milwaukee Electric Tool Corporation, Brookfield, WI (US); Techtronic Power Tools Technology Limited, Tortola (VG)

( * ) Notice: Subject to any disclaimer, the term of this patent is extended or adjusted under 35 U.S.C. 154(b) by 868 days.

(21) Appl. No.: 12/991,753

(22) PCT Filed: May 8, 2009

(86) PCT No.: PCT/US2009/043365

§ 371 (c)(1),
(2), (4) Date: Jan. 31, 2011

(87) PCT Pub. No.: WO2009/137808

PCT Pub. Date: Nov. 12, 2009

(65) Prior Publication Data

US 2011/0120741 A1 May 26, 2011

Related U.S. Application Data

(60) Provisional application No. 61/051,892, filed on May 9, 2008.

(51) Int. Cl.
*B25D 17/04* (2006.01)

(52) U.S. Cl.
USPC ..... 173/170; 16/421

(58) Field of Classification Search
USPC ..... 173/170, 162.2; 16/116 R, 421
See application file for complete search history.

(56) References Cited

U.S. PATENT DOCUMENTS 4,820,090 A 4/1989 Chen
4,998,588 A 3/1991 Manschitz (Continued)

FOREIGN PATENT DOCUMENTS

DE 2801828 A * 7/1979
DE 2801828 A1 7/1979

(Continued)

OTHER PUBLICATIONS

PCT/US2009/043365 International Search Report and Written Opinion.

(Continued)

*Primary Examiner* — Stephen F Gerrity
*Assistant Examiner* — Eyamindae Jallow
(74) *Attorney, Agent, or Firm* — Michael Best & Friedrich LLP

(57) ABSTRACT

An auxiliary handle for use with a power tool includes a first clamp for engaging a housing of the power tool at a first location, and a second clamp for engaging the housing at a second location. The second clamp is movable independent from the first clamp in a first direction toward the first clamp to couple the auxiliary handle to the housing and the second clamp movable independent from the first clamp in a second direction away from the first clamp to uncouple the auxiliary handle from the housing. The auxiliary handle further includes a grip operable to move the second clamp in at least one of the first and the second directions, and together the first clamp and the second clamp surround only a portion of a chuck of the power tool.

12 Claims, 12 Drawing Sheets

(56) References Cited

U.S. PATENT DOCUMENTS

| | | | | |
|---|---|---|---|---|
| 5,049,012 | A | 9/1991 | Cavedo | |
| 5,213,017 | A | 5/1993 | Jones et al. | |
| 5,269,045 | A | 12/1993 | DeSerio et al. | |
| 5,671,815 | A | 9/1997 | Kabatnik et al. | |
| 5,730,232 | A | 3/1998 | Mixer | |
| 5,996,707 | A | 12/1999 | Thome et al. | |
| D426,760 | S | 6/2000 | Schultz | |
| D431,766 | S | 10/2000 | Zurwelle | |
| D442,452 | S | 5/2001 | Stirm et al. | |
| D447,032 | S | 8/2001 | Schoen et al. | |
| D448,638 | S | 10/2001 | Uhl et al. | |
| D460,336 | S | 7/2002 | Pretzell | |
| 6,415,875 | B1 | 7/2002 | Meixner et al. | |
| 6,484,361 | B1 | 11/2002 | Schmid et al. | |
| D470,379 | S | 2/2003 | Andriolo | |
| 6,520,270 | B2 | 2/2003 | Wissmach et al. | |
| 6,551,525 | B2 | 4/2003 | Hofmann et al. | |
| 6,595,300 | B2 | 7/2003 | Milbourne | |
| 6,609,860 | B2 | 8/2003 | Wanek et al. | |
| 6,679,406 | B2 | 1/2004 | Sakai et al. | |
| 6,691,799 | B2 | 2/2004 | Kuhnle et al. | |
| D487,686 | S | 3/2004 | Milbourne | |
| D488,978 | S | 4/2004 | Cheung | |
| 6,722,449 | B2 | 4/2004 | Lebisch et al. | |
| 6,739,406 | B2 | 5/2004 | Lebisch et al. | |
| D491,438 | S | 6/2004 | Cheung et al. | |
| D494,033 | S | 8/2004 | Thomas et al. | |
| 6,776,244 | B2 | 8/2004 | Milbourne | |
| 6,799,643 | B2 | 10/2004 | Voulkidis et al. | |
| 6,814,156 | B2 | 11/2004 | Dieterle et al. | |
| 6,843,330 | B2 | 1/2005 | Schmid et al. | |
| D501,385 | S | 2/2005 | Cheung et al. | |
| D502,374 | S | 3/2005 | Aglassinger | |
| D502,375 | S | 3/2005 | Aglassinger | |
| D502,377 | S | 3/2005 | Aglassinger | |
| D503,079 | S | 3/2005 | Aglassinger | |
| 6,863,479 | B2 | 3/2005 | Frauhammer et al. | |
| 6,907,942 | B2 | 6/2005 | Kikuchi et al. | |
| 6,913,088 | B2 | 7/2005 | Berger | |
| D507,950 | S | 8/2005 | Aglassinger | |
| D508,388 | S | 8/2005 | Aglassinger | |
| 6,923,271 | B2 | 8/2005 | Frauhammer et al. | |
| D511,286 | S | 11/2005 | Aglassinger | |
| 6,988,562 | B2 | 1/2006 | Hecht | |
| D515,382 | S | 2/2006 | Andriolo | |
| D515,383 | S | 2/2006 | Aglassinger | |
| 7,000,709 | B2 | 2/2006 | Milbourne | |
| D518,347 | S | 4/2006 | Corcoran | |
| 7,021,400 | B2 | 4/2006 | Oretti | |
| D520,320 | S | 5/2006 | Corcoran | |
| D520,833 | S | 5/2006 | Andriolo | |
| D521,337 | S | 5/2006 | Cheung et al. | |
| 7,055,620 | B2 | 6/2006 | Nadig et al. | |
| D525,846 | S | 8/2006 | Corcoran | |
| 7,137,542 | B2 * | 11/2006 | Oki et al. | 173/162.2 |
| D533,420 | S | 12/2006 | Waldron | |
| D533,421 | S | 12/2006 | Aglassinger | |
| 7,144,206 | B2 | 12/2006 | Burger et al. | |
| D534,407 | S | 1/2007 | Waldron | |
| D540,643 | S | 4/2007 | Waldron | |
| D543,819 | S | 6/2007 | Lee | |
| D546,154 | S | 7/2007 | Fong et al. | |
| 7,252,156 | B2 * | 8/2007 | Sugiyama et al. | 173/162.1 |
| D551,527 | S | 9/2007 | Aglassinger | |
| D559,059 | S | 1/2008 | Concari | |
| 7,708,260 | B2 * | 5/2010 | Eicher et al. | 267/207 |
| 7,721,390 | B2 * | 5/2010 | Pfeiffer et al. | 16/426 |
| 8,316,957 | B2 * | 11/2012 | Kuhnle et al. | 173/162.2 |
| 8,371,708 | B2 * | 2/2013 | Nagasaka et al. | 362/109 |
| 8,430,183 | B2 * | 4/2013 | Di Nicolantonio et al. | 173/162.2 |
| 2002/0021947 | A1 | 2/2002 | Hofmann et al. | |
| 2002/0054796 | A1 | 5/2002 | Plank | |
| 2003/0188877 | A1 | 10/2003 | Saur et al. | |
| 2004/0177981 | A1 | 9/2004 | Berger | |
| 2005/0082072 | A1 * | 4/2005 | Nicolantonio et al. | 173/162.2 |
| 2005/0087353 | A1 * | 4/2005 | Oki et al. | 173/162.2 |
| 2005/0161241 | A1 * | 7/2005 | Frauhammer et al. | 173/1 |
| 2005/0284648 | A1 | 12/2005 | Frauhammer et al. | |
| 2006/0130279 | A1 | 6/2006 | Sattler | |
| 2006/0185867 | A1 | 8/2006 | Frauhammer et al. | |
| 2006/0219419 | A1 * | 10/2006 | Sugiyama et al. | 173/162.2 |
| 2007/0151035 | A1 | 7/2007 | Chen | |
| 2007/0289761 | A1 * | 12/2007 | Kumpf et al. | 173/162.1 |
| 2008/0223593 | A1 * | 9/2008 | Eicher et al. | 173/162.2 |
| 2009/0038120 | A1 * | 2/2009 | Eicher et al. | 16/426 |
| 2009/0038818 | A1 * | 2/2009 | Eicher et al. | 173/162.2 |
| 2010/0206595 | A1 * | 8/2010 | Kamegai | 173/162.2 |

FOREIGN PATENT DOCUMENTS

| | | | | |
|---|---|---|---|---|
| DE | 3829801 | A1 | | 3/1990 |
| GB | 2165480 | A | * | 4/1986 |
| WO | 2008/025605 | A1 | | 3/2008 |

OTHER PUBLICATIONS

Office Action from the United Kingdom Intellectual Property Office for Application No. 1019404.1 dated Mar. 21, 2012 (2 pages).

* cited by examiner

AUXILIARY HANDLE FOR USE WITH A POWER TOOL

CROSS-REFERENCE TO RELATED APPLICATIONS

This application claims priority to U.S. Provisional Patent Application No. 61/051,892, filed May 9, 2008, the entire contents of which are hereby incorporated by reference herein.

BACKGROUND OF THE INVENTION

The present invention relates to power tools and, more particularly, to auxiliary handles for use with power tools.

Some power tools, such as hammer drills, include pistol-shaped housings that are grasped by a user with a single hand during operation. However, holding a power tool with only one hand can make it difficult to gain sufficient leverage to properly operate the power tool. It is therefore common to provide an auxiliary handle on such a power tool so that a user may grasp the power tool with both hands during operation. However, auxiliary handles typically extend outwardly from the side of power tools in a fixed direction, making the power tools cumbersome to operate in more confined locations.

SUMMARY OF THE INVENTION

In one embodiment, the invention provides an auxiliary handle for use with a power tool having a housing that defines a handle end portion and a chuck end portion and a chuck is located at the chuck end portion of the housing. The auxiliary handle includes a first clamp for engaging the housing at a first location, and a second clamp for engaging the housing at a second location. The second clamp is movable independent from the first clamp in a first direction toward the first clamp to couple the auxiliary handle to the housing and the second clamp is movable independent from the first clamp in a second direction away from the first clamp to uncouple the auxiliary handle from the housing. The auxiliary handle further includes a grip operable to move the second clamp in at least one of the first and the second directions, and together the first clamp and the second clamp surround only a portion of the chuck.

In another embodiment the invention provides an auxiliary handle for use with a power tool having a housing that defines a handle end portion and a chuck end portion. The auxiliary handle includes a grip, a rod that extends from the grip, and a first clamp coupled to the rod. The first clamp engages the housing at a first location. The auxiliary handle further includes a second clamp coupled to the rod that engages the housing at a second location. The second clamp is movable independent from the first clamp in a first direction toward the first clamp to couple the auxiliary handle to the housing and the second clamp is movable independent from the first clamp in a second direction away from the first clamp to uncouple the auxiliary handle from the housing. A biasing member biases the second clamp in the first direction toward the first clamp.

In another embodiment the invention provides a power tool that includes a housing having a handle portion and a chuck end portion. A chuck is positioned at the chuck end portion of the housing. A first aperture formed in the housing, and a second aperture formed in the housing. An auxiliary handle is removably coupled to the housing at the chuck end portion, and the auxiliary handle includes, a first clamp for engaging the housing in the first aperture, and a second clamp for engaging the housing in the second aperture. The auxiliary handle further includes a grip operable to move the second clamp in at least one of the first and the second directions. The second clamp is movable independent from the first clamp in a first direction toward the first clamp to couple the auxiliary handle to the housing and the second clamp is movable independent from the first clamp in a second direction away from the first clamp to uncouple the auxiliary handle from the housing. Together the first clamp and the second clamp engage the housing around only a portion of the chuck.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting.

DETAILED DESCRIPTION

Figure 1:
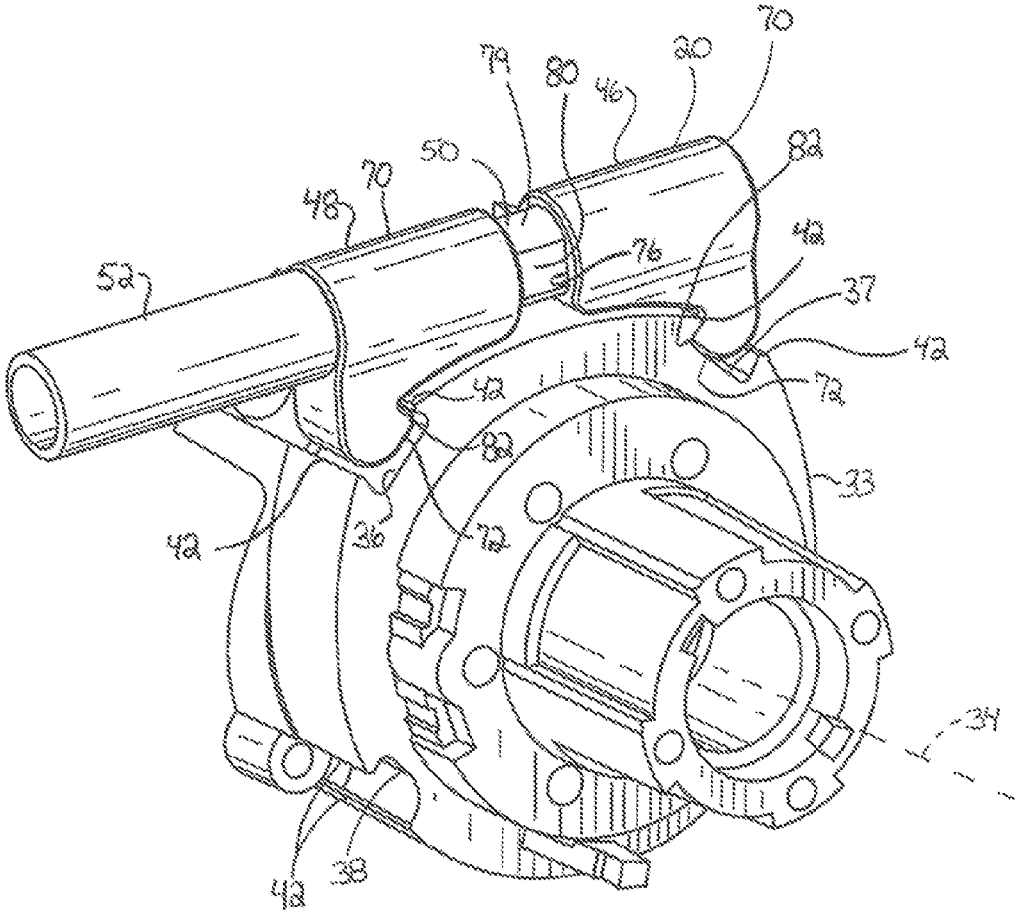
FIG. 1 is a perspective view of a portion of an auxiliary handle for a power tool and a portion of a power tool according to one embodiment of the invention.
Figure 2:
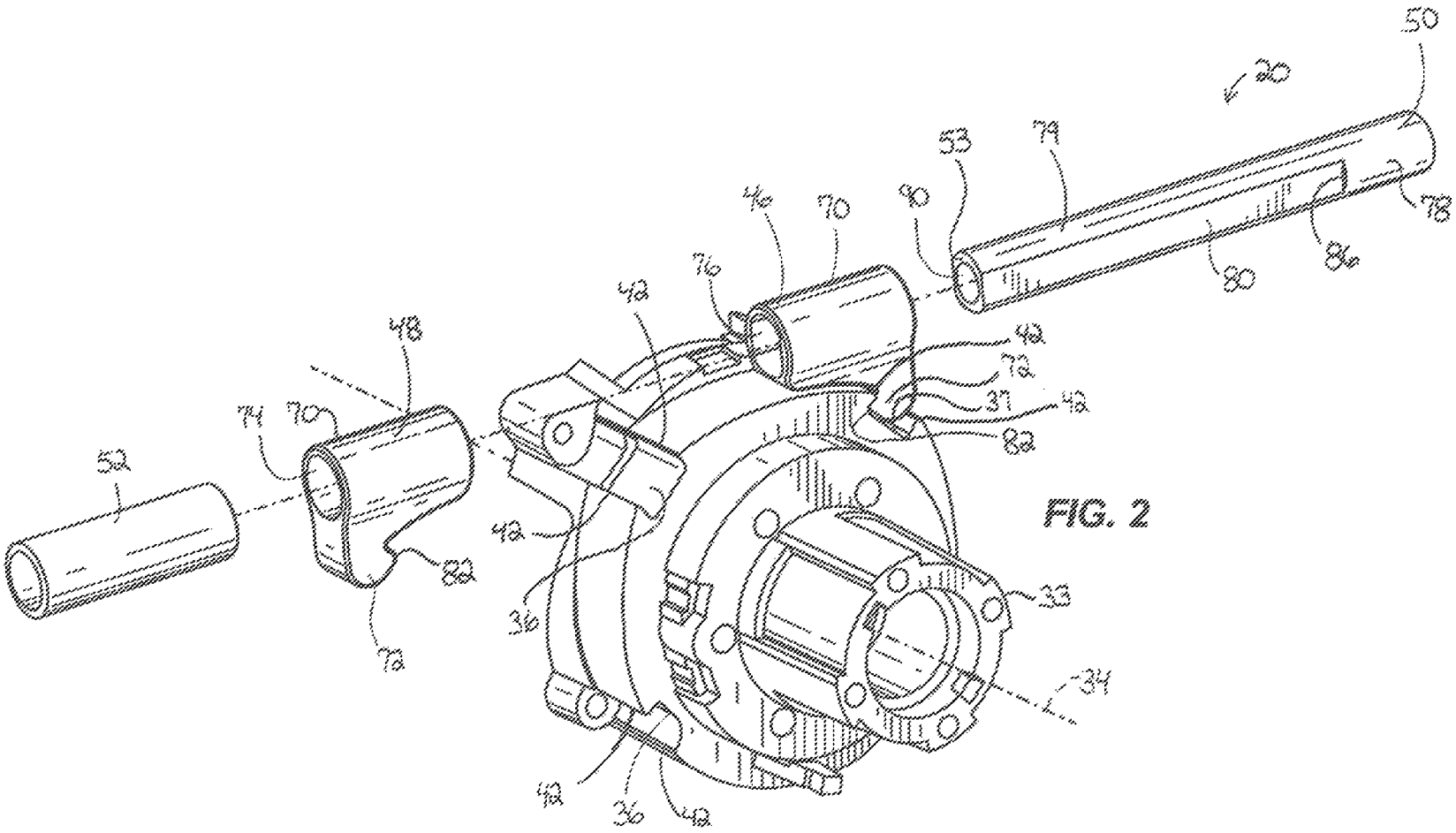
FIG. 2 is a partially exploded view of FIG. 1.
Figure 11:
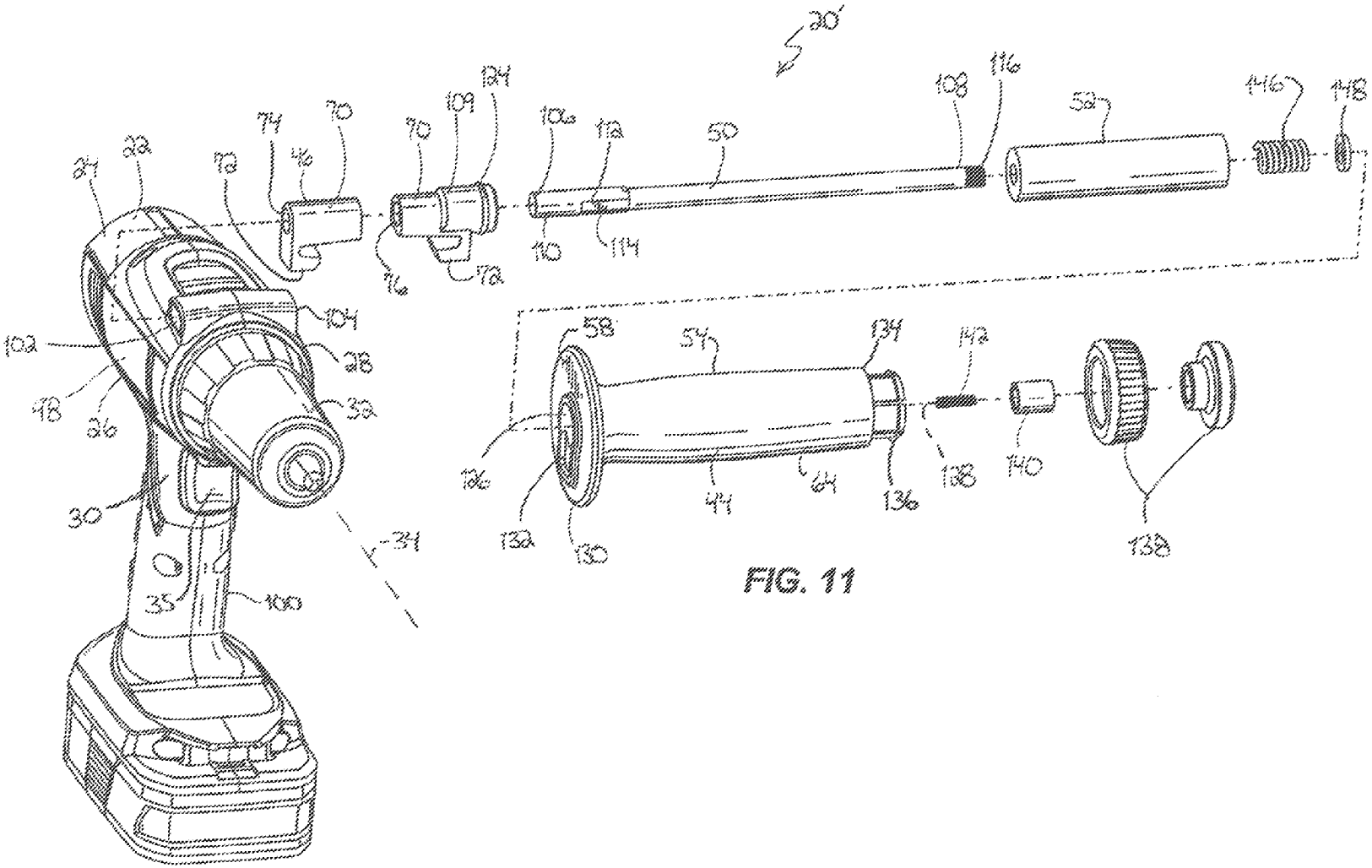
FIG. 11 is a partially exploded view of an auxiliary handle and a power tool according to another embodiment of the invention.

FIGS. 1-2 illustrate an auxiliary or side handle 20 according to one embodiment of the invention. The illustrated side handle 20 is removably coupled to a power tool, such as, a hammer drill, to provide a second location on the power tool for a user to grasp and hold the power tool. For example, in some embodiments, the power tool may include a pistol-shaped housing that a user holds with one hand during operation. Such a power tool 22 is illustrated in FIG. 11 along with an auxiliary handle 20' according to another embodiment of the invention, which will be described in more detail below. The illustrated power tool 22 of FIG. 11 is a drill that includes a housing 24 having a handle end 26 and a chuck end 28. The housing 24 forms a main handle 30 at the handle end 26 and a chuck 32 extends from the chuck end 28, and is configured to couple a tool, such as a drill bit or the like, to the drill 22 along a chuck axis 34. An actuator 35 is positioned adjacent the main handle 30. The actuator 35 is operable by the user to operate the chuck 32, e.g., rotate the chuck 32, and thereby rotate the tool held by the chuck 32.

With reference to the first embodiment of the side handle 20, which is illustrated in FIGS. 1-10, only a portion of the power tool housing is illustrated, which is a gear casing 33. However, the sidle handle 20 may be coupled to other portions of the power tool housing. As illustrated in FIG. 1, when the side handle 20 is coupled to or engaged with the gear casing 33, the side handle 20 extends in a direction generally perpendicular relative to the axis 34 that extends through a motor, a drive mechanism, a chuck, and a working piece (e.g., a drill bit, a saw blade, a screwdriver bit, etc.) of the power tool.

Figure 9:
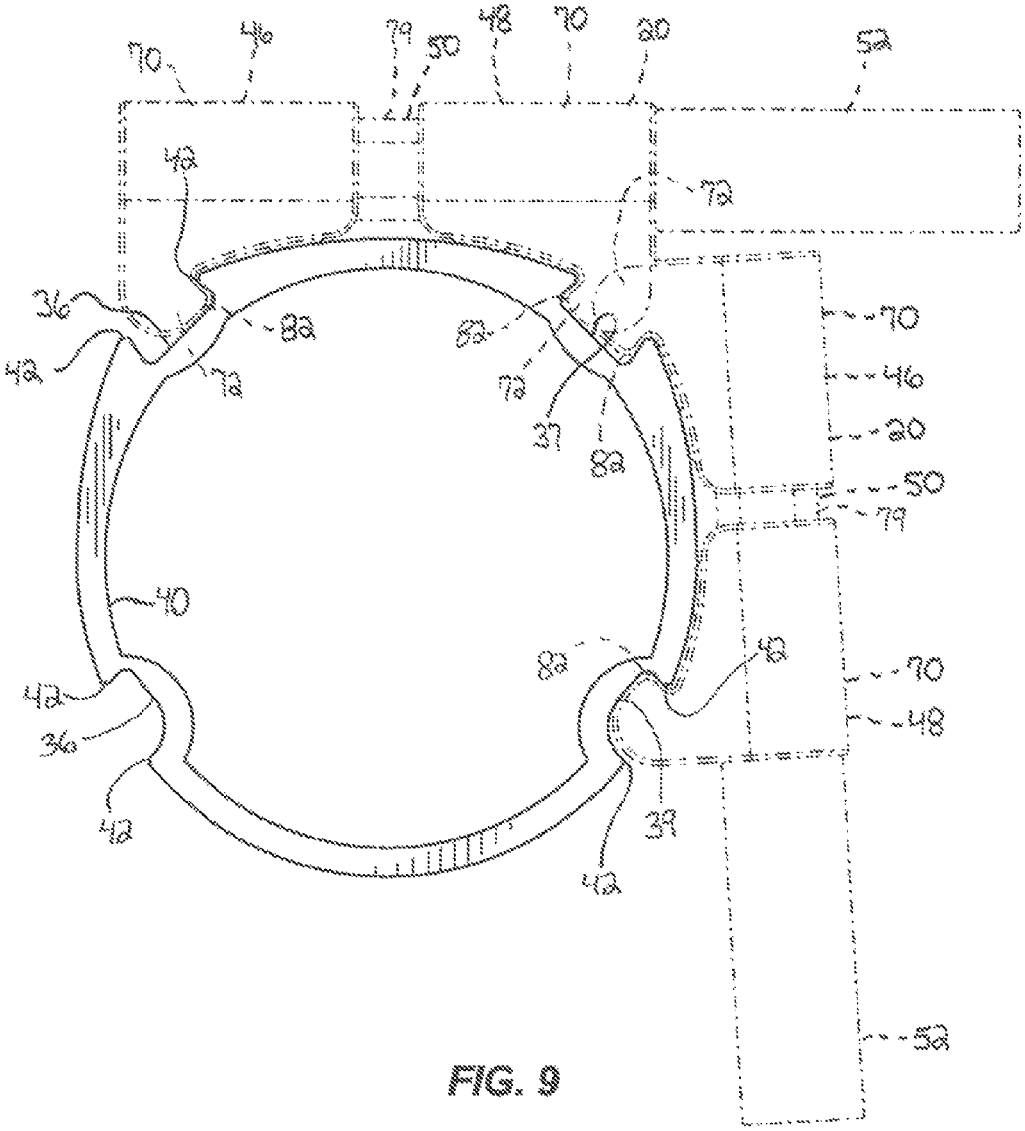
FIG. 9 illustrates the portion of the auxiliary handle of FIG. 1 in alternative positions on a power tool.

The illustrated gear casing 33 defines four apertures 36, 37, 38, 39 (FIG. 9), which are notches, formed in the gear casing 33. Alternatively, as illustrated in FIG. 9, the apertures 36-39 may be formed in a separate ring 40 that is supported on the power tool adjacent to a clutch ring (not shown). In other embodiments, the apertures 36-39 may be formed in other suitable locations on different types of power tools.

The illustrated first and second apertures 36, 37 are formed in an upper portion of the gear casing 33, while the third and fourth apertures 38, 39 are formed in a lower portion of the gear casing 33. The gear casing 33 includes two nose portions 42 adjacent each of the first and second apertures 36, 37 such that the side handle 20 may be repositioned relative the power tool (i.e., the side handle 20 may extend outwardly to the left or to the right of the gear casing 33). Further, the gear casing 33 includes two nose portions 42 adjacent each of the third and fourth apertures 38, 39 such that the side handle 20 may be oriented in additional positions relative to the gear casing 33. For example, the side handle 20 may extend upward or downward from the gear casing 33 or extend outwardly to the left or right from the lower portion of the gear casing 33. The nose portions 42 extend partially over the apertures 36-39 to inhibit the side handle 20 from separating or being pulled apart from the power tool or gear casing 33 after the side handle 20 is tightened in place or coupled to the power tool.

The side handle 20 includes a grip 44 (FIG. 3), a first clamp 46, a second clamp 48, a rod 50, and a sleeve 52. The first clamp 46 and the second clamp 48 are configured to be received in two adjacent apertures 36-39 of the power tool 22 to connect or couple the side handle 20 to the power tool 22. The rod 50 extends through the first and second clamps 46, 48 and is threadably engaged with the grip 44. The rod 50 also extends through the sleeve 52, and the sleeve 52 is positioned between the second clamp 48 and the grip 44. As the grip 44 is coupled (e.g., threaded in the illustrated embodiment) to an end 53 of the rod 50 opposite the first clamp 46, the grip 44 engages the sleeve 52 to push the second clamp 48 in a direction toward the first clamp 46. The second clamp 48 thereby moves independently from the first clamp 46 along the rod 50 toward the first clamp 46 such that the clamps 46, 48 tightly engage a portion of the gear casing 33 therebetween to couple the side handle 20 to the power tool.

Figure 3:
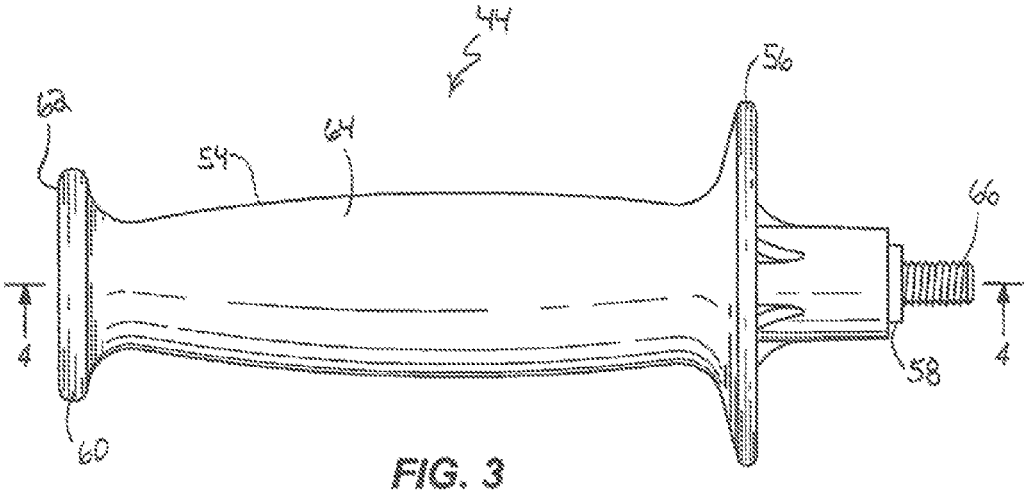
FIG. 3 is a side view of a grip according to one embodiment of the invention for use with the portion of the auxiliary handle of FIG. 1.
Figure 4:
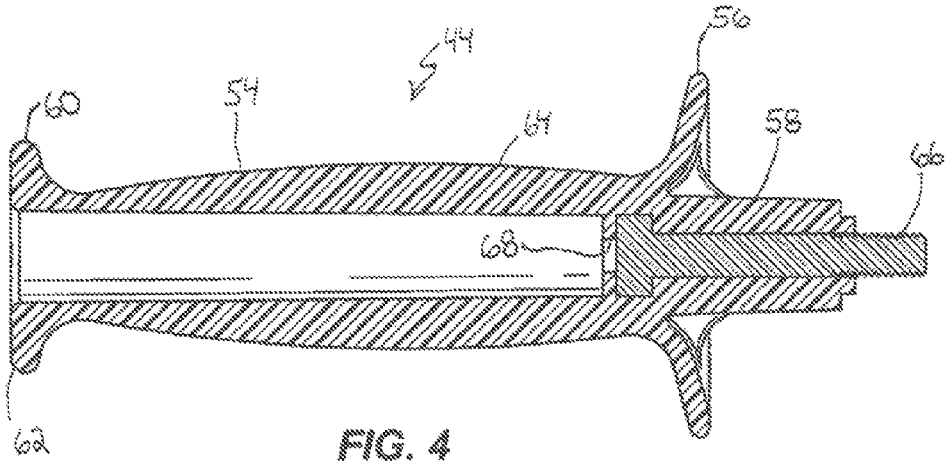
FIG. 4 is a cross-sectional view of the grip of FIG. 3 taken along line 4-4 of FIG. 3.

Referring to FIG. 3, the grip 44 is illustrated in more detail. The grip 44 includes a substantially hollow body portion 54 having a first flange 56 adjacent a first end portion 58 and a second flange 60 adjacent a second end portion 62 spaced apart from the first end portion 58. A middle portion 64 of the body 54 between the flanges 56, 60 may be texturized or coated with an elastomeric material to facilitate grasping of the grip 44. The illustrated grip 44 also includes a fastener 66 positioned partially within the body 54 and coupled to the body 54 for rotation with the body 54. While the illustrated fastener 66 is a threaded fastener (e.g. bolt), in other embodiments other suitable types of fasteners may be used. The fastener 66 extends outwardly from the first end portion 58 of the body 54 and is configured to engage the rod 50 (FIG. 2). In the illustrated embodiment, the fastener 66 threadably couples to the end 53 of the rod 50 to couple the side handle 20 to gear casing 33 of the power tool, as further described below. An inner lip 68 formed inside the body 54 maintains the fastener 66 in place within the body 54.

Figure 5:
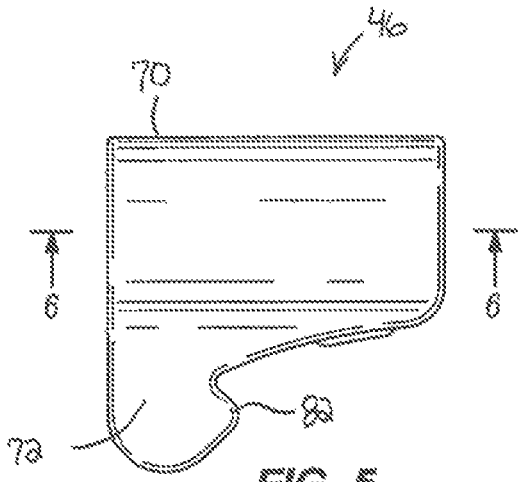
FIG. 5 is a side view of a clamp of the auxiliary handle of FIG. 1.
Figure 6:
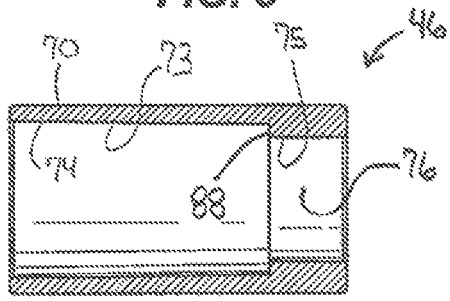
FIG. 6 is a cross-sectional view of the clamp of FIG. 5 taken along line 6-6 of FIG. 5.

The first clamp 46 is illustrated in more detail in FIGS. 5 and 6. Although only the first clamp 46 is described below, the first and second clamps 46, 48 are substantially identical in the illustrated embodiment and, therefore, interchangeable. As such, like parts between the first and second clamps 46, 48 have been given the same reference numbers.

Figure 7:
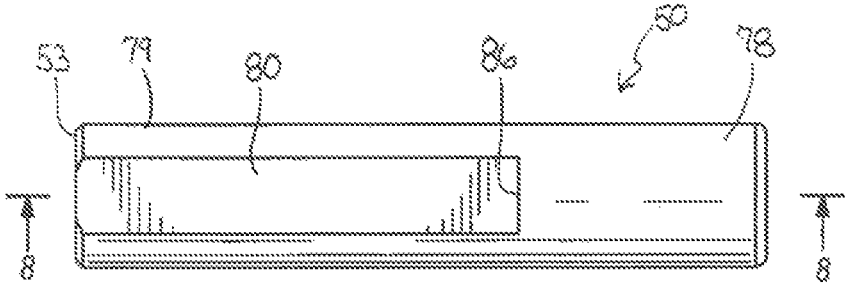
FIG. 7 is a side view of a rod of the auxiliary handle of FIG. 1.

As shown in FIGS. 5 and 6, the first clamp 46 includes a body portion 70 and a leg portion 72 integrally formed as a single piece with the body portion 70. The body portion 70 includes a passageway 73 having a first portion 74 that is substantially circular or cylindrical and a second portion 75 having flat sidewalls 76. The first portion 74 of the passageway 73 is shaped and sized to receive a first portion 78 of the rod 50, which is substantially cylindrical (FIG. 7), while the second portion 75 is shaped and sized to receive a second portion 79 of the rod 50 including flat sidewalls 80 (FIG. 7). The leg portion 72 of the first clamp 46 is configured to be received in one of the apertures 36-39 of the gear casing 33 of the power tool. In the illustrated embodiment, the leg portion 72 includes a protrusion 82 configured to fit within the nose portion 42 of the corresponding aperture 36-39 to inhibit the clamp 46 from separating from the gear casing 33.

Figure 8:
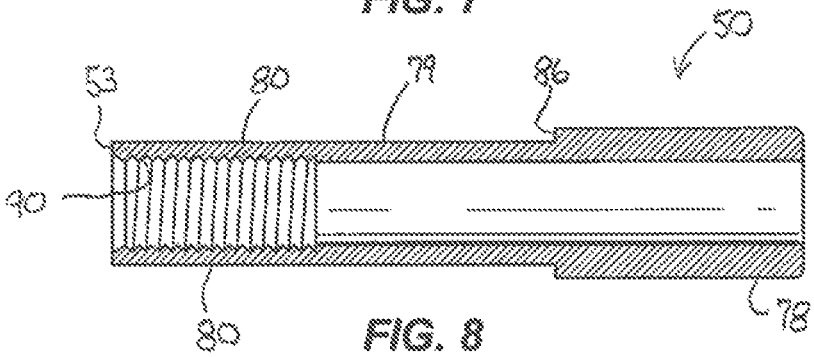
FIG. 8 is a cross-sectional view of the rod of FIG. 7 taken along line 8-8 of FIG. 7.

Referring to FIGS. 7 and 8, the rod 50 includes the first portion 78, which is cylindrical, and the second portion 79 having the flat sidewalls 80. In the illustrated embodiment, the second portion 79 includes two flat sidewalls 80 that are sized to fit within each of the second portions 75 of the clamps 46, 48, which include two flat sidewalls 76. The flat sidewalls 80 of the rod 50 and the flat sidewalls 76 of the clamps 46, 48 prevent rotation of the clamps 46, 48 about the rod 50 to ensure that the clamps 46, 48 are properly aligned with one another and, thereby, the apertures 36-39 in the power tool. The flat sidewalls 80 of the rod 50 also decrease the size of the second portion 79 of the rod 50 relative to the first portion 78 such that a lip 86 is defined at a transition from the first portion 78 to the second portion 79. The lip 86 engages a ledge 88 within the first clamp 46 to prevent the rod 50 from sliding entirely through the first clamp 46. In other embodiments, such as some of the embodiments described below, the first clamp may be fixed to the rod, such as by welding, interference fit, integrally forming the clamp with the rod, and the like. The rod 50 also includes an inner portion 90 at the end 53 configured to couple the grip 44 to the rod 50 by receiving a portion of the fastener 66 of the grip 44 (FIG. 3).

Referring to FIGS. 2 and 3, the sleeve 52 is a generally cylindrical tube sized to fit about the first end portion 58 of the grip 44 and the second portion 79 of the rod 50. When the grip 44 is coupled to the rod 50, the grip 44 pushes the sleeve 52 such that the sleeve 52 engages or pushes against the second clamp 48 to push the second clamp 48 toward the first clamp 46. Seated in two of the apertures 36-39, the first and second clamps 46, 48 tightly engage, or squeeze, a portion of the gear casing 33 of the power tool between the respective apertures 36-39, thereby securely coupling the side handle 20 to the power tool. In the illustrated embodiment, the portion 90 of the rod 50 is threaded to receive the threaded fastener 66 of the grip 44 in order to couple the grip 44 to the rod 50. In other embodiments, other types and combinations of fasteners can be utilized.

To connect the side handle 20 to the gear casing 33 of the power tool, the leg portions 72 of the first and second clamps 46, 48 are positioned within corresponding apertures 36, 37 in the gear casing 33, as shown in FIG. 1. If not already partially coupled to the rod 50, the fastener 66 of the grip 44 is inserted into the sleeve 52 until the fastener 66 engages the inner threaded portion 90 of the rod 50. The grip 44 is then rotated to threadably couple the fastener 66 to the rod 50.

As the grip 44 is threaded or rotated into the rod 50, the grip 44 pushes the sleeve 52 against the second clamp 48, and the lip 86 formed on the rod 50 pushes against the ledge 88 in the first clamp 46. The first and second clamps 46, 48 are thereby pushed together. The protrusion 82 on each clamp 46, 48 slides into one of the nose portions 42 of the corresponding aperture 36, 37. The grip 44 continues to be rotated until the clamps 46, 48 tightly engage a portion of the gear casing 33 therebetween. Accordingly, when the side handle 20 is coupled to the power tool, the first and second clamps 46, 48 surround only a portion of the circumference of the gear casing 33. Likewise, if the side handle 20 was similarly coupled to the drill 22 of FIG. 11, the first and second clamps 46, 48 would only surround a portion of an outer circumference of the chuck 32. Whereas, if a clamp or clamps surrounded an entire circumference of the chuck 32 (e.g., 360 degrees around the axis 34), the user would need to insert the chuck through the aperture formed by the clamps. This can often require aligning multiple projections or other features of such clamps with recesses in the tool housing as the user inserts the entire chuck through the clamp or clamps meanwhile, while also inserting and aligning the chuck, including the bit or the like, through an aperture formed by the clamp. However, in the illustrated embodiment, the user does not need to insert the chuck 32 through an aperture formed by the clamps. Rather, the user simply attaches the clamps 46, 48 to the top, side, or bottom of the gear casing 33 as discussed above.

To remove the side handle 20 from the power tool, the grip 44 is rotated in an opposite direction, releasing pressure between sleeve 52 and the second clamp 48, and thereby between the rod 50 and the ledge 88 in the first clamp 46. The second clamp 48 is then slid slightly away from the first clamp 46 along the rod 50 such that the protrusions 82 formed on the leg portions 72 of the clamps 46, 48 may move out of the nose portions 42 in the corresponding apertures 36, 37.

Figure 10:
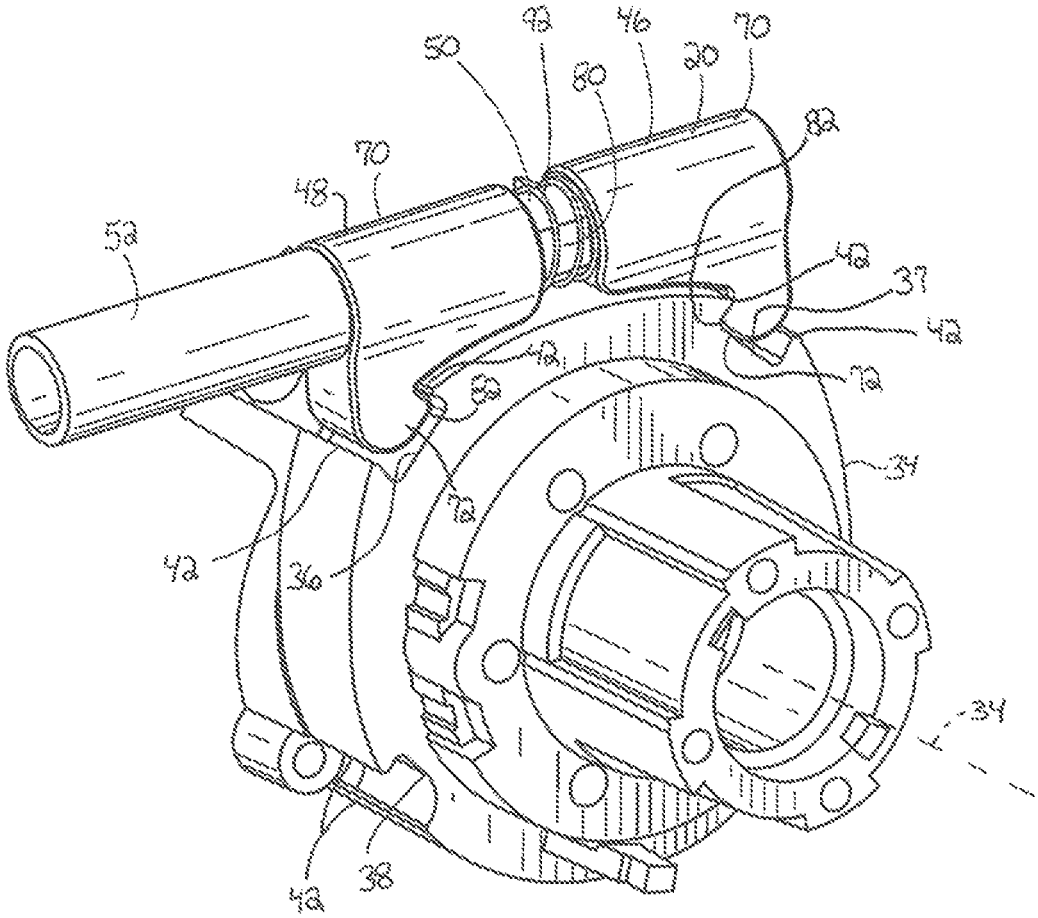
FIG. 10 illustrates a portion of an auxiliary handle according to another embodiment of the invention.

In a further embodiment, and as illustrated in FIG. 10, a biasing member 92, which is a coil spring in the illustrated embodiment, is positioned between the first clamp 46 and the second clamp 48 about the rod 50 to bias the clamps 46, 48 apart from one another. Once the protrusions 82 of the clamps 46, 48 are clear of the nose portions 42 of the apertures 36, 37, the clamps 46, 48 are slid or lifted out of the apertures 36, 37, thereby disconnecting or uncoupling the side handle 20 from the gear casing 33 of the power tool.

As shown in FIG. 9, the side handle 20 may be oriented in a variety of positions relative to a power tool. In the illustrated embodiment, the side handle 20 is oriented in a first position and a second position relative to the housing, which is the ring 40 in FIG. 9 instead of the gear casing 33 of FIG. 1. When in the first position, the first and second clamps 46, 48 of the side handle 20 engage the aperture 36 and the aperture 37 of the ring 40, respectively, such that the grip 44 would extend outwardly from the power tool 22 in an opposite direction from the grip position illustrated in FIG. 1. When in the second position, the first and second clamps 46, 48 engage the aperture 37 and the aperture 39, respectively, such that the grip 44 would extend substantially downwardly from the ring 40. The side handle 20 is capable of being oriented in other positions as well. For example, the first clamp 46 may engage any one of the apertures 36-39 in either direction to position the side handle 20 in any of eight possible orientations, two of which are illustrated in FIG. 9. Adjusting the orientation of the side handle 20 relative to a power tool allows the side handle 20 to be changed for left-handed or right-handed operation of the power tool. In addition, the illustrated side handle 20 allows the power tool to be quickly and easily reconfigured for operation in more confined locations.

Figure 12:
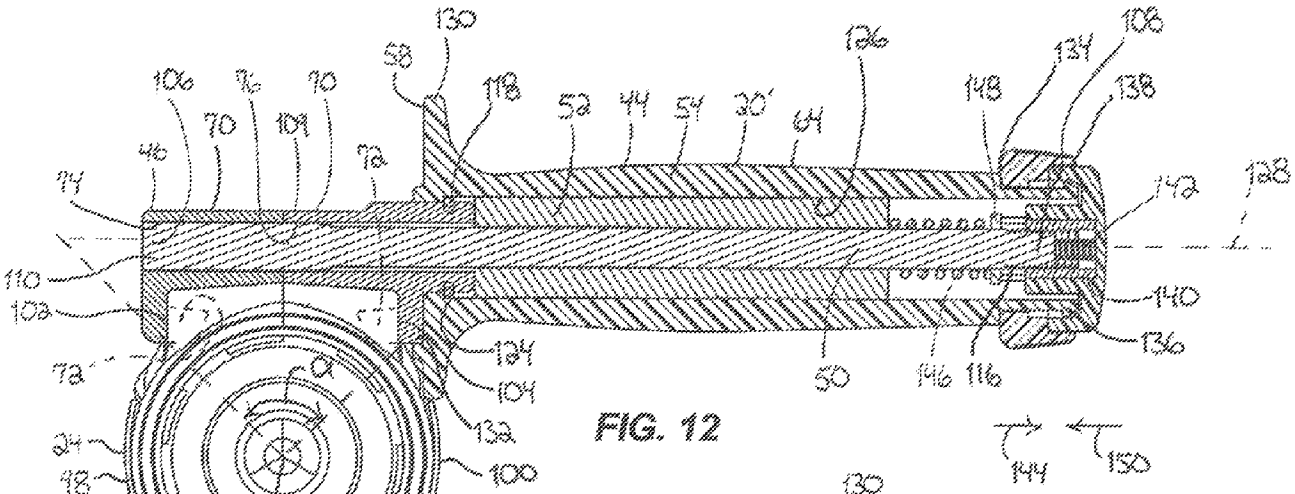
FIG. 12 is a partial cross-sectional view of the auxiliary handle and power tool of FIG. 11, with the handle in a first position.
Figure 13:
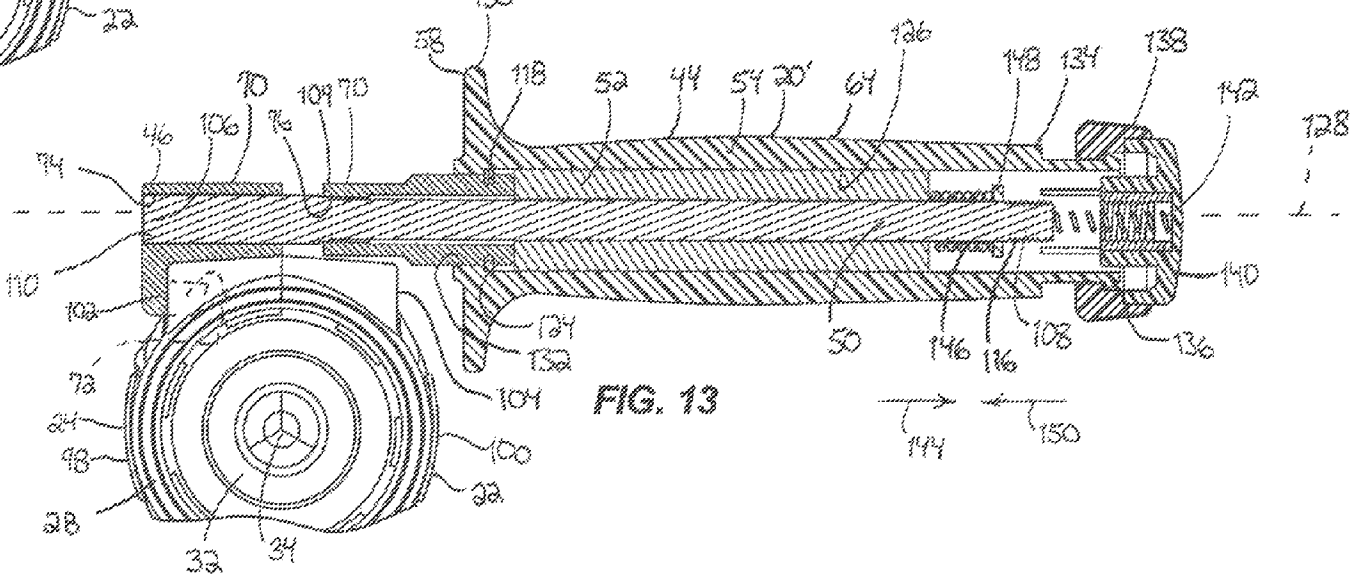
FIG. 13 is a partial cross-sectional view of the auxiliary handle and power tool of FIG. 11, with the handle in a second position.

FIGS. 11-13 illustrate a side handle 20' according to another embodiment of the invention. The side handle 20' is similar to the side handle 20 of FIGS. 1-10; therefore, like components have been giving like reference numbers and only some differences between the side handles 20 and 20' will be discussed herein.

Referring to FIGS. 11-13, the side handle 20' is removably coupled to the power tool 22, which is a drill in the illustrated embodiment. The drill 22 includes the housing 24 having a first side 98 and a second side 100. As illustrated in FIG. 11, the first side 98 generally forms a first half of the housing and the second side 100 generally forms a second half of the housing such that the first and second sides 98, 100 are coupled to define a substantial portion of the housing 24. A first aperture 102 is integrally formed in the first side 98 of the drill housing 24 and a second aperture 104 is integrally formed in the second side 100 of the drill housing 24. The first and second apertures 102, 104 are formed in the respective sides 98, 100 such that the apertures 102, 104 open in directly opposed directions.

The illustrated side handle 20' includes the rod 50 having a first end portion 106 and a second end portion 108, the first clamp 46 and a second clamp 109. The first end portion 106 of the rod 50 includes a first portion 110, which is cylindrical, and a second portion 112 having flat sidewalls 114. The second end portion 108 of the rod 50 includes a fastener 116, which is a threaded end of the rod 50 in the illustrated embodiment. In another embodiment, the fastener 116 may be a threaded fastener or bolt coupled to the end portion 108 of the rod 50. The first clamp 46 is coupled to the first end portion 106 of the rod 50 such that the first clamp 46 is fixed from movement with respect to the rod 50, such as by welding, interference fit, adhesives, and the like. In other embodiments, the first clamp 46 may be removably coupled, yet generally fixed with respect to the rod 50. For example, the rod 50 may be configured such that an end of the rod 50 receives a bolt to removably couple the first clamp 46 to the rod 50, yet the bolt would hold the first clamp 46 fixed with respect to the rod 50 when the clamp 46 is coupled to the rod. Such a configuration allows for the first clamp 46 to be removed if the first clamp 46 would happen to break or become damaged. In yet other embodiments, such as the embodiment illustrated in FIGS. 1-10, the first clamp 46 may be movable with respect to the rod 50.

Similar to the clamps 46 and 109 of the side handle 20 having passageways 73 with the flat sidewalls 75 (FIG. 6), the clamps 46 and 109 of the side handle 20' of FIGS. 11-13 also include similar passageways and flat sidewalls. The flat sidewalls and passageways allow the clamps 46, 109 of the side handle 20' to slide along the rod 50, specifically, along the second portion 112 of the rod 50 having the flat sidewalls 114 and yet the flat sidewalls 114 prevent the clamps 46, 109 of the side handle 20' from rotating around the rod 50.

With continued reference to FIGS. 11-13, the illustrated second clamp 109 further includes a circumferential groove 118 formed adjacent an end of the clamp 109 and a retaining ring 124 positioned within the groove 118 to couple the second clamp 109 to the grip 44 for movement with the grip 44 along the rod 50.

The grip 44 includes the hollow body portion 54 that defines a bore 126 extending through the first end 58 of the grip 44. The grip 44 defines a longitudinal axis 128 that extends through the center of the bore 126. Referring to FIGS. 11 and 12, a first flange 130 of the grip 44 includes a clamp recess 132 for receiving a portion of the second clamp 109 such that the second clamp 109 rotates along with the grip 44 about the rod 50 and the longitudinal axis 128. As best seen in FIG. 11, the clamp recess 132 is formed on an outer surface of the first flange 130 and the recess 132 extends radially outward from the bore 126 of the grip 44. The recess 132 receives a portion of the leg 72 of the clamp 109 such that when the grip 44 is rotated about the rod 50 the clamp 109 also rotates about the rod 50 along with the grip 44.

A second end 134 of the grip 44 includes a hook 136, an end cap 138, and a fastener 140. As best seen in FIGS. 12 and 13, the hook 136 and the end cap 138 are configured such that the end cap 138 is axially movable with respect to the hook 136 and the body 54 of the grip 44 along the longitudinal axis 128 of the grip 44. The hook 136 limits axial movement of the end cap 138 along the longitudinal axis 128 to the position illustrated in FIG. 13. Further, the end cap 138 is rotatable with respect to the hook 136 and the body 54 of the grip 44 about the longitudinal axis 128. The end cap 138 retains the fastener 140, which is a threaded female bushing in the illustrated embodiment. The end cap 138 and the fastener 140 are coupled such that the fastener 140 both translates and rotates with the end cap 138. A biasing member 142, which is a coil spring in the illustrated embodiment, is positioned between the end of the rod 50 and the end cap 138, partially within the fastener 140 in order to bias the end cap 138 in the direction of arrow 144. As best seen in FIG. 11, the illustrated end cap 138 is formed from two separate components, which are shown as exploded in FIG. 11. In other embodiments, the end cap may be formed as a single component or from more than two components.

The auxiliary handle 20' further includes the sleeve 52, a handle and clamp biasing member 146, and a washer 148. The washer 148 is fixed to the second end portion 108 of the rod 50. The sleeve 52 is positioned within the bore 126 of the grip 44 and about the rod 50, between the washer 148 and the second clamp 109. The rod 50 extends through the sleeve 52, and the sleeve 52 surrounds the rod 50 such that the sleeve 52 may move axially along the rod 52 (e.g., longitudinal axis 128 of the grip 44) and rotate about the rod 50. The biasing member 146, which is a coil spring in the illustrated embodiment, biases the sleeve 52 toward the second clamp 109 or in the direction of arrow 150.

In operation, FIG. 12 illustrates the handle 20' coupled to or engaged with the drill 22. To uncouple or disconnect the handle 20' from the drill 22, the user rotates the end cap 138 with respect to the rod 50 and the body 54 of the grip 44 in order to disengage or unthread the fastener 116 of the rod 50 and the fastener 140 of the grip 44. When the fasteners 116, 140 disengage, the spring 142 biases the cap 138 away from the rod 50 until the cap 138 is prevented from further movement in the direction of arrow 144 by the hook 136, which is illustrated in FIG. 13. Next, referring to FIG. 13, the user pulls the grip 44 in the direction of arrow 144 (i.e., away from the drill 22), against the bias of the spring 146, to remove the leg 72 of the second clamp 109 from the second aperture 104 in the housing 24. The user rotates the grip 44 approximately 90 degrees about the rod 50 and axis 128 of the grip 44 such that the grip 44 and the second clamp 109 are in a release position, which is the position illustrated in FIG. 13. Rotation of the grip 44 causes a corresponding rotation of the second clamp 109 such that the leg 72 of the clamp 109 is no longer aligned with the aperture 104. With the second clamp 109 in the release position, the user may slide the handle 20' in the direction of arrow 150 (i.e., towards the drill 22) to remove the leg 72 of the first clamp 46 from the first aperture 102, and thereby uncouple or disconnect the handle 20' from the drill 22.

To connect or couple the handle 20' to the drill 22, the user inserts the leg 72 of the first clamp 46 into the first aperture 102 (FIG. 13). The user then pulls the grip 44 in the direction of arrow 144 so that the leg 72 of the second clamp 109 is past the end or opening of the second aperture 104 (FIG. 13). Next, the user rotates the grip 44 to rotate the second clamp 109 and align the leg 72 of the clamp 109 with the second aperture 104. With the leg 72 and the second aperture 104 aligned, the user releases the grip 44. Releasing the grip 44 causes the spring 146 to move the sleeve 52, and therefore second clamp 109 and grip 44, along the rod 50 and axis 128 until the leg 72 is received within the second aperture 104 (FIG. 12). The user may then push the end cap 138 in the direction of arrow 150, against the bias of spring 142, to engage the fastener 140 and the fastener 116. The user rotates the end cap 138, and thus fastener 140, to thread or engage the fasteners 116, 140, thereby coupling or connecting the handle 20' to the drill 22. Contact between the first and second clamps 46, 109 limits tightening of the fastener 140, and therefore the clamping pressure applied by the clamps 46, 109 to the drill housing 24.

Similar to the handle 20 of FIGS. 1-10, the clamps 46, 109 of the handle 20' of FIGS. 11-13 only surround a portion of the chuck 32 when the handle 20' is coupled to the housing 24. Therefore, in the illustrated embodiment, referring to the handle 20', the user couples the handle 20 to the drill by simply inserting the clamps 46, 109 in respective apertures 102, 104. As represented by the angle $\alpha$ in FIG. 12, the clamps 46, 109 together surround only about a 90 degree portion of the chuck 32. In other embodiments, the angle $\alpha$ can be more or less than 90 degrees. As discussed above with regard to the handle 20 of FIGS. 1-11, the clamps 46, 109 of the handle 20' surround only a portion of the circumference of the chuck 32 and the clamps 46, 109 do not surround an entire circumference of the chuck 32. While not illustrated, the first clamp 46 may be inserted into either aperture 102 or 104 to change the orientation of the side handle 20' with respect to the drill housing 24. While the illustrated drill 22 includes only the two apertures 102, 104, in other embodiments, the drill 20 may include more than two apertures to allow the user additional options for orientating the handle 20' with respect to the drill 22. For example, the drill 20 may include apertures (similar to the apertures 102, 104) located beneath the chuck 32 in addition to the illustrated apertures 102, 104 that are generally positioned above the chuck 32.

Figure 14:
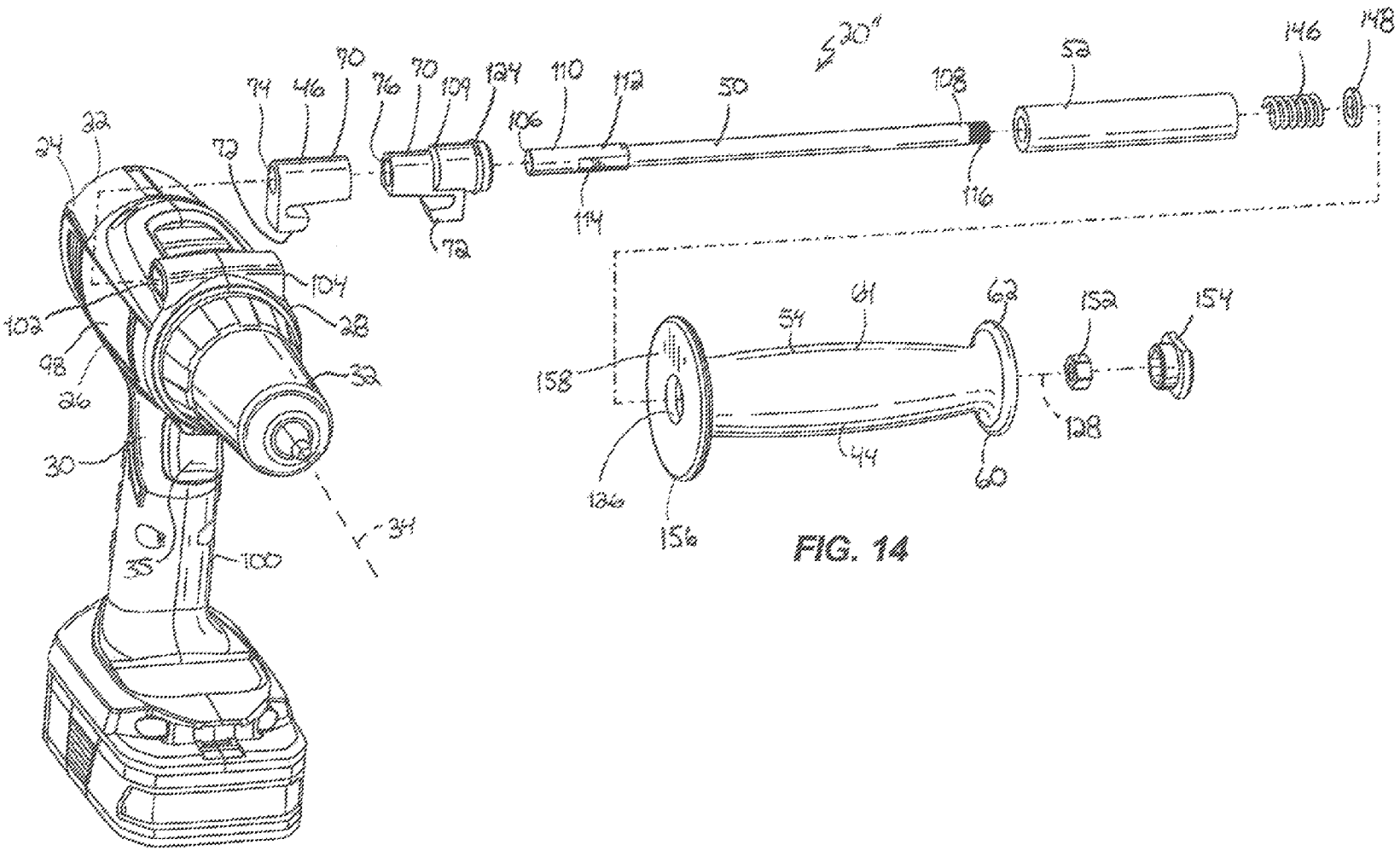
FIG. 14 is a partially exploded view of an auxiliary handle and a power tool according to yet another embodiment of the invention.
Figure 15:
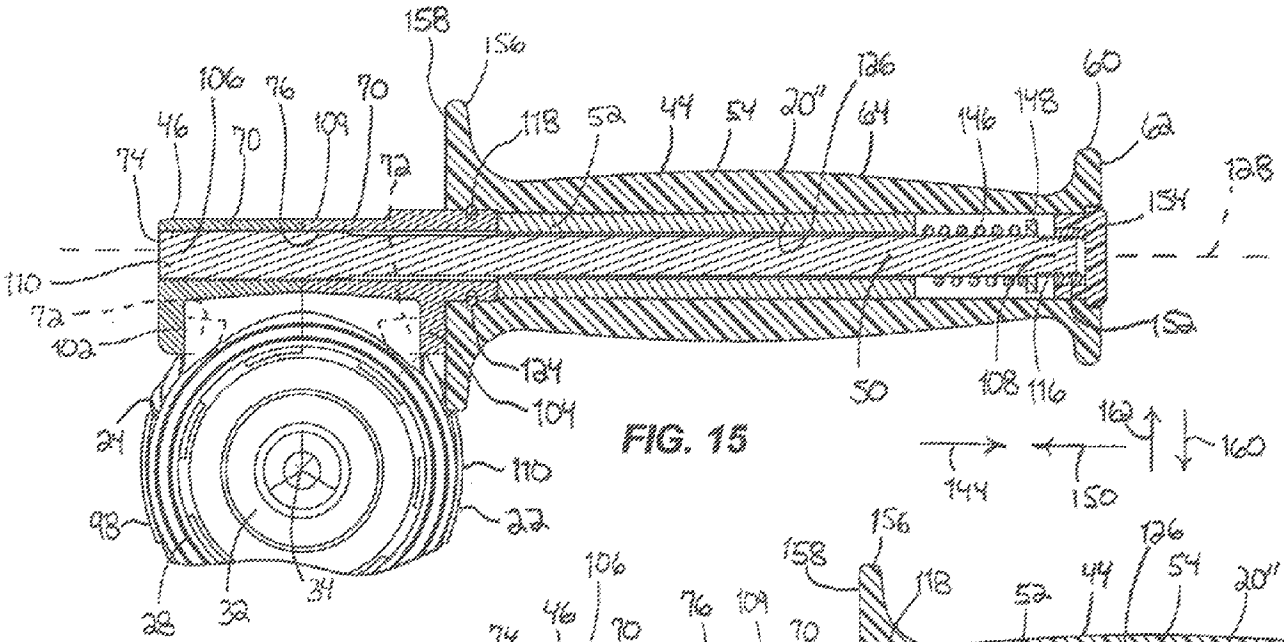
FIG. 15 is a partial cross-sectional view of the auxiliary handle and power tool of FIG. 14, with the handle in a first position.
Figure 16:
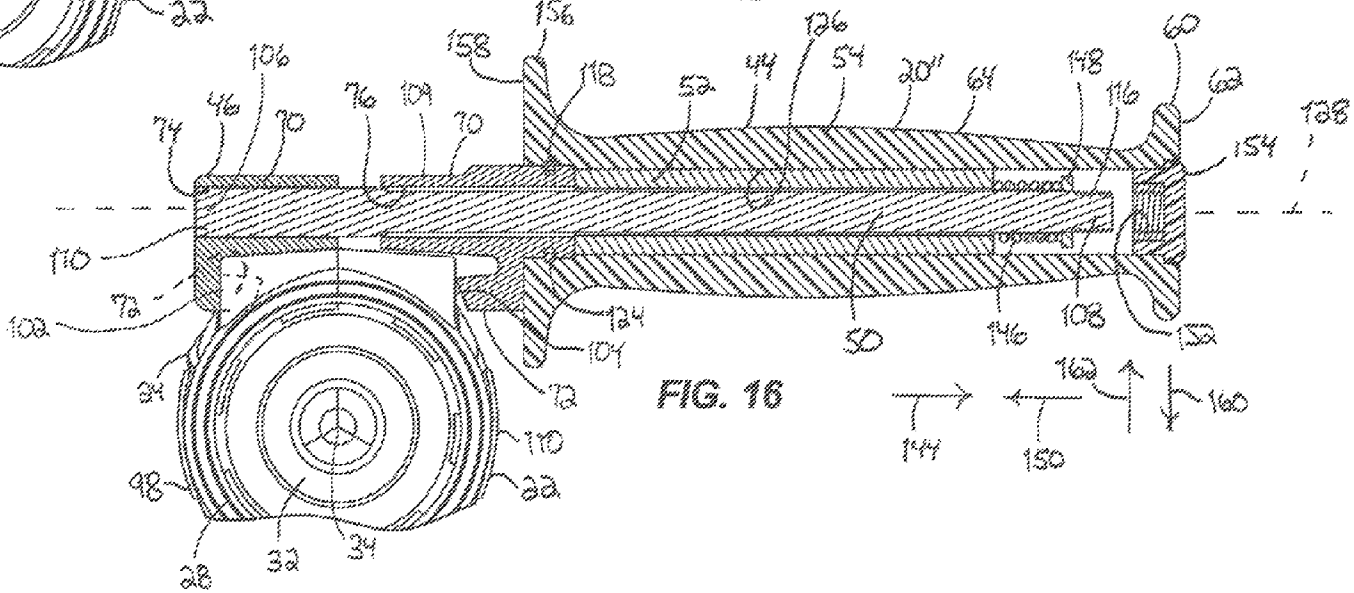
FIG. 16 is a partial cross-sectional view of the auxiliary handle and power tool of FIG. 14, with the handle in a second position.

FIGS. 14-16 illustrate an auxiliary handle 20" according to another embodiment of the invention. The auxiliary handle 20" of FIGS. 14-16 is similar to the auxiliary handle 20' of FIGS. 11-13; therefore, like components have been giving like reference numbers and only some differences between the embodiments of FIGS. 14-16 and FIGS. 11-13 will be discussed herein.

Referring to FIGS. 14-16, the handle 20" includes a fastener 152 and an end cap 154 coupled to the grip 44 such that the fastener 152 and the end cap 154 both rotate with the grip 44 about the rod 50 and axially move with the grip 44 along the rod 50. The grip 44 includes a flange 156 having a generally flat outer surface 158 adjacent the bore 126, which allows the grip 44 to rotate with respect to the second clamp 109. In comparison, the grip 44 of the handle 20' includes the recess 126 (FIG. 11) to couple the second clamp 109 and the grip 44 for co-rotation about the rod 50. Similar to the handle 20', the retaining ring 124 of the handle 20" couples the grip 44 and the second clamp 109 for movement together along the rod 50.

Referring to FIGS. 15 and 16, in operation, to connect or couple the handle 20" to the drill 22, the user inserts the leg 72 of the first clamp 46 into the first aperture 102 (FIG. 16). The user then pulls the grip 44 in the direction of arrow 144 so that the leg 72 of the second clamp 109 is past the end or opening of the second aperture 104 (FIG. 16). Next, the user moves the handle 20" and second clamp 109 slightly downward or in the direction of arrow 160 of FIG. 16 in order to align the leg 72 of the clamp 109 with the second aperture 104. With the leg 72 and the second aperture 104 aligned, the user releases the grip 44. Releasing the grip 44 causes the spring 146 to move the sleeve 52, and therefore the second clamp 109 and the grip 44, along the rod 50 and axis 128 until the leg 72 is received within the second aperture 104 (FIG. 15). The user then rotates the grip 44, which rotates the fastener 152 to thread onto or engage with the fastener 116 of the rod 50, thereby coupling or connecting the handle 20" to the drill 22. Contact between the first and second clamps 46, 109 limits tightening of the fastener 152, and therefore the clamping pressure applied by the clamps 46, 109 to the drill housing 24.

To uncouple the handle 20" from the drill 22, the user rotates the entire grip 44 to disengage the fastener 152 from the fastener 116 of the rod 50. Next, the user pulls the grip 44 in the direction of arrow 144 along the rod 50, thereby pulling the second clamp 109 away from the first clamp 46 and against the bias of the spring 146. The grip 44 is pulled until the leg 72 of the clamp 109 is removed from the second aperture 104 in order to place the handle 20" in a release position, which is illustrated in FIG. 16. The user pivots the handle 20" about the leg 72 of the first clamp 46 generally in the direction of arrow 162 and simultaneously slides the handle 20" in the direction of arrow 150 to remove the first clamp 46 from the first aperture 102, which thereby removes or uncouples the handle 20" from the drill 22.

Figure 17:
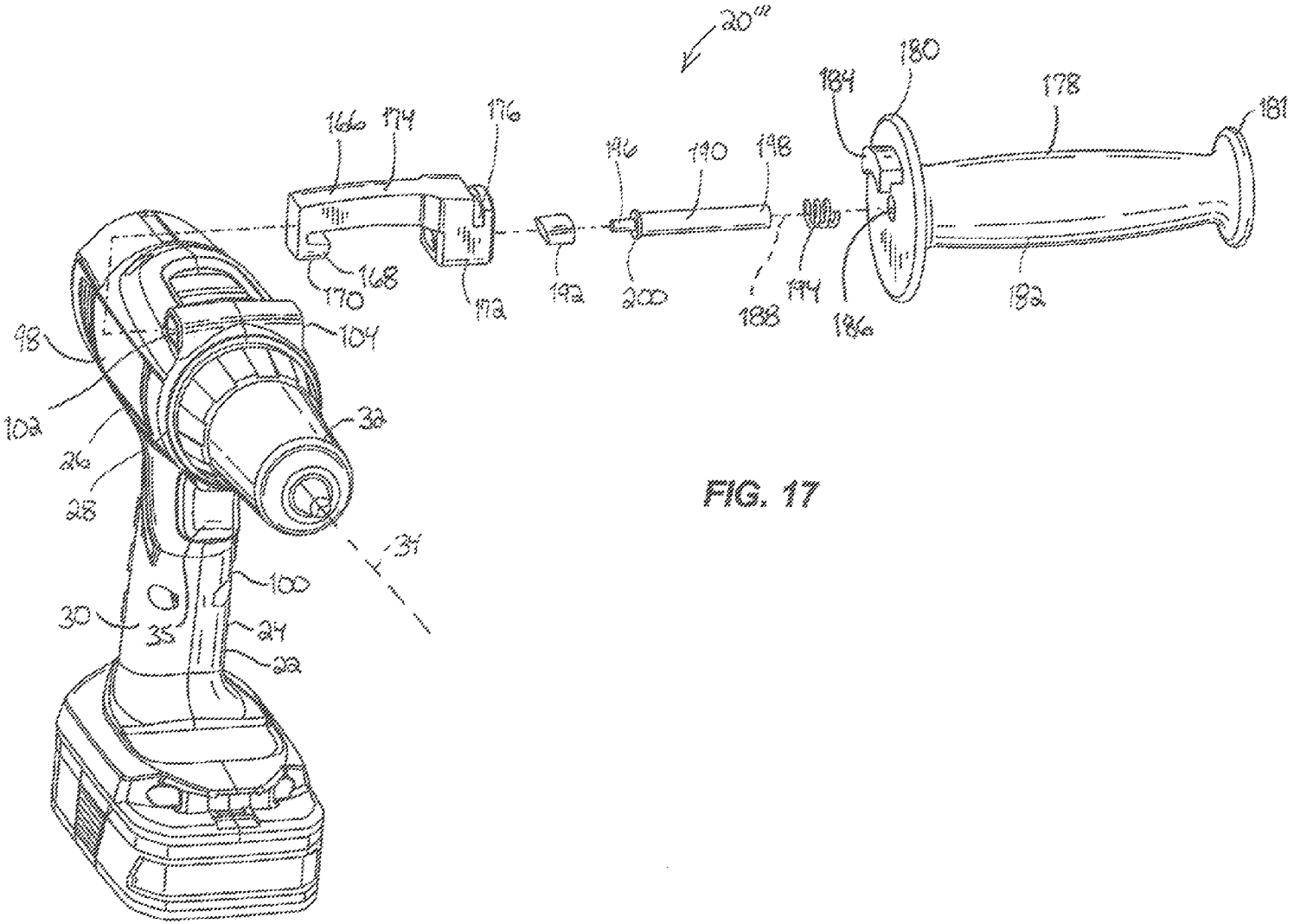
FIG. 17 is a partially exploded view of an auxiliary handle and a power tool according to another embodiment of the invention.
Figure 18:
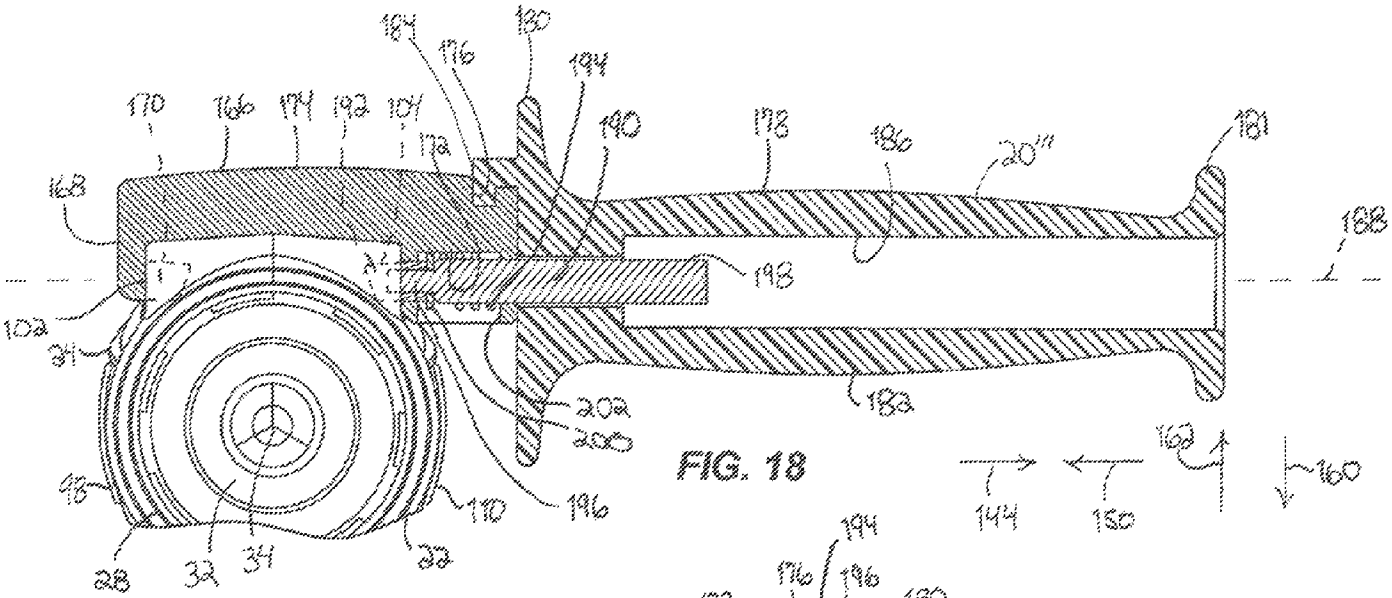
FIG. 18 is a partial cross-sectional view of the auxiliary handle and power tool of FIG. 17, with the handle in a first position.
Figure 19:
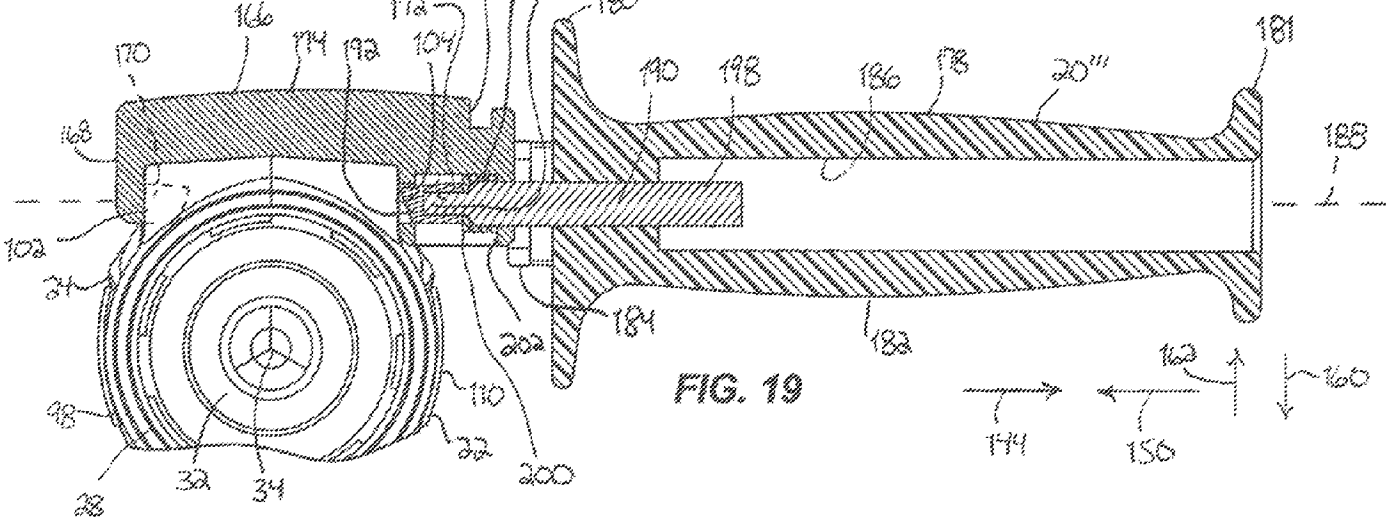
FIG. 19 is a partial cross-sectional view of the auxiliary handle and power tool of FIG. 17, with the handle in a second position.

FIGS. 17-19 illustrate an auxiliary handle 20'" according to another embodiment of the invention. The auxiliary handle 20'" of FIGS. 17-19 is similar to the auxiliary handles 20', 20" of FIGS. 11-13 and 14-16, respectively; therefore, like components have been given like reference numbers and only the differences between the embodiments will be discussed herein.

Referring to FIG. 17, the auxiliary handle 20'" includes a clamp body 166. The clamp body 166 includes a leg portion 168 that forms a first clamp 170 of the auxiliary handle 20'". The clamp body 166 further includes a clamp housing 172, and a cross member 174 that extends from the leg portion 168 to the clamp housing 172. An arcuate slot 176 is formed adjacent the clamp housing 172.

The auxiliary handle 20'" further includes a grip 178. The grip 178 includes a first grip flange 180 and a second grip flange 181, which are separated by a hollow body portion 182. The first grip flange 180 includes an arcuate shaped fastener 184 that is sized to slide within the slot 176 of the clamp body 166. In the illustrated embodiment, the fastener 184 is integrally formed, such as by molding, as a single piece with the flange 180 of the grip 178. A bore 186 extends through the grip 178 along a longitudinal axis 188 of the grip 178.

The auxiliary handle 20'" further includes a rod 190, a second clamp 192, and a biasing member 194. The rod 190 includes a first end portion 196 that is cylindrical and has a smaller diameter than a cylindrical second end portion 198 of the rod 190. A washer 200 is positioned around the first end portion 196 and is fixed to the rod 190, as illustrated in FIG. 17. The second clamp 192 receives the first end portion 196 of the rod 190 and the second clamp 192 is fixed to the rod 190, as shown in FIGS. 18 and 19. Alternatively, the second clamp 192 may be integrally formed as a single piece with the first end portion 196 of the rod 190.

Referring to FIGS. 18 and 19, when the handle 20'" is assembled, the biasing member 194, which is a coil spring in the illustrated embodiment, is positioned within a cavity 202 of the clamp housing 172 and sits between the clamp housing 172 and the washer 200. The biasing member 194 biases the rod 190 in the direction of arrow 150 along the longitudinal axis 188 of the grip 178. The second clamp 192 is coupled to the rod 190 for movement with the rod 190 and therefore, the spring 194 also biases the second clamp 192 in the direction of arrow 150. The grip 178 is coupled to the rod 190 such that the grip 178 translates (i.e., in the directions of arrows 144, 150) with the rod 190; however, the grip is able to rotate about the rod 190 and the longitudinal axis 188.

Referring to FIG. 18, in operation, to couple the handle 20'" to the drill 22, the user places the handle 20'" in the position illustrated in FIG. 19 with the first clamp 170 in the first aperture 102 and the second clamp 192 removed from the second aperture 104 (i.e., with the grip axially pulled away from the clamp housing 172). The user then releases the grip 178, which causes the spring 194 to move the grip 178, rod 190, and the second clamp 192 in the direction of arrow 150 until the second clamp 192 is seated in the second aperture 104, as illustrated in FIG. 18. The user then rotates the grip 178 approximately 90 degrees until the fastener 184 is received within the slot 176 of the clamp body 166 to secure the handle 20'" to the drill 22.

To uncouple the handle 20'" from the drill 22, the user rotates the grip 178 with respect to the rod 190 approximately 90 degrees such that the fastener 184 slides out of the slot 176 in the clamp body 166. Once the grip 178 is disengaged from the clamp body 166, the user is able to pull the grip 178 in the direction of arrow 144 and against the bias of the spring 194 to the release position of the handle 20'", which is the position illustrated in FIG. 19. Axial movement of the grip 178, and thereby the rod 190, removes the second clamp 192 from the second aperture 104. The user is then able to pivot the handle 20'" generally in the direction of arrow 162 and slide the handle 20''' generally in the direction of arrow 150 to remove the first clamp 170 from the first aperture 102 to thereby uncouple the handle 20''' from the drill 22.

Although the invention has been described in detail with reference to certain embodiments, variations and modifications exist within the scope and spirit of one or more independent aspects of the invention as described.

What is claimed is:

1. An auxiliary handle for use with a power tool having a housing that defines a handle end portion and a chuck end portion, the auxiliary handle comprising:

a grip;

a rod that extends from the grip;

a first clamp coupled to the rod, the first clamp for engaging the housing at a first location;

a second clamp coupled to the rod and for engaging the housing at a second location, the second clamp movable independent from the first clamp in a first direction toward the first clamp to couple the auxiliary handle to the housing and the second clamp movable independent from the first clamp in a second direction away from the first clamp to uncouple the auxiliary handle from the housing; and a biasing member that biases the second clamp in the first direction toward the first clamp.

2. The auxiliary handle of claim 1, wherein the grip defines a longitudinal axis and the second clamp is movable in the first and second directions along the longitudinal axis of the grip.

3. The auxiliary handle of claim 2, wherein the second clamp is coupled to the grip for movement with the grip along the longitudinal axis, and wherein the grip and the second clamp are coupled for co-rotation about the longitudinal axis.

4. The auxiliary handle of claim 1, wherein the second clamp is movably coupled to the rod.

5. The auxiliary handle of claim 1, wherein the second clamp is formed by an end portion of the rod.

6. The auxiliary handle of claim 1, wherein the second clamp includes an aperture that extends through the second clamp and the rod extends through the aperture of the second clamp such that the second clamp is movable along the rod in the first direction toward the first clamp.

7. The auxiliary handle of claim 1, further comprising a sleeve, wherein the rod extends through the sleeve and the sleeve is movable along the rod to move the second clamp in the first direction toward the first clamp.

8. The auxiliary handle of claim 7, wherein the grip includes a longitudinal aperture extending at least partially through the grip, wherein the sleeve is at least partially located within the aperture of the grip and coupled to the grip for movement with the grip such that the biasing member biases the sleeve and the grip in the direction toward the first clamp.

9. The auxiliary handle of claim 8, wherein the grip includes a fastener rotatable with respect to the rod to inhibit movement of the grip and the sleeve in the second direction away from the first clamp.

10. An auxiliary handle for use with a power tool having a housing that defines a handle end portion and a chuck end portion, a chuck located at the chuck end portion of the housing and configured to rotate about a chuck axis, the auxiliary handle comprising:

a first clamp for engaging the housing at a first location;

a second clamp for engaging the housing at a second location, the second clamp movable independent from the first clamp in a first direction toward the first clamp to couple the auxiliary handle to the housing and the second clamp movable independent from the first clamp in a second direction away from the first clamp to uncouple the auxiliary handle from the housing; and a grip operable to move the second clamp in at least one of the first and the second directions; and a biasing member that biases the grip and the second clamp in the first direction toward the first clamp, wherein together the first clamp and the second clamp surround only a portion of the chuck axis, the auxiliary handle further comprising, and wherein the grip defines a longitudinal axis and the second clamp is movable in the first and second directions along the longitudinal axis of the grip.

11. The auxiliary handle of claim 10, wherein the grip includes a longitudinal aperture extending at least partially through the grip, and wherein the biasing member is at least partially located within the longitudinal aperture of the grip.

12. The auxiliary handle of claim 10, wherein the second clamp is coupled to the grip for movement with the grip, and wherein the grip and the second clamp are rotatable about the longitudinal axis.

* * * * *